US005642146A

United States Patent [19]

Uchiyama

[11] Patent Number: 5,642,146

[45] Date of Patent: Jun. 24, 1997

[54] PRINTER HAVING TRANSPORT DEVICE FOR CORRECTING IMAGE DISTORTION

[75] Inventor: Tadamitsu Uchiyama, Ebina, Japan

[73] Assignee: Minolta Camera Kabushiki Kaisha, Osaka, Japan

[21] Appl. No.: 249,285

[22] Filed: May 25, 1994

[30] Foreign Application Priority Data

May 25, 1993 [JP] Japan ..... 5-122600

[51] Int. Cl.[6] ..... B41J 2/385

[52] U.S. Cl. ..... 347/130; 347/139; 347/140

[58] Field of Search ..... 347/238, 132, 347/134, 139, 140, 130

[56] References Cited

U.S. PATENT DOCUMENTS 4,963,894 10/1990 Lebeau et al. ..... 347/238

5,235,348 8/1993 Avonts ..... 347/238

FOREIGN PATENT DOCUMENTS 59-7966 1/1984 Japan .

4-114181 4/1992 Japan .

*Primary Examiner*—Mark J. Reinhart

*Attorney, Agent, or Firm*—Burns, Doane, Swecker & Mathis, LLP

[57] ABSTRACT

An optical device for forming a latent image on the surface of a photosensitive member by an optical head, developing the latent image and transferring the developed toner image onto a transfer sheet at a transferring section. The transfer sheet is transported at least at the transfer section in a direction inclined relative to a direction perpendicular to the rotation axis of the photosensitive member at an angle of distortion of the latent image which occurs when the optical head forms the latent image on the surface of the photosensitive member, thereby toner particles in the transfer section receive twisting force and the distortion of the latent image is corrected when the latent image is transferred to the transfer sheet.

8 Claims, 7 Drawing Sheets

10
a
b
L
Lp
θ
twisting transfer

S
rolling contact transfer
rolling contact transfer

S

S

PRINTER HAVING TRANSPORT DEVICE FOR CORRECTING IMAGE DISTORTION

BACKGROUND OF THE INVENTION

1. Field of the Invention

The present invention relates to an optical printer, and more specifically relates to an optical printer having a print head which scans the surface of a photosensitive member at constant speed via the ON/OFF switching of the light emitted by said print head in accordance with image information so as to form an electrostatic latent image on said surface of the photosensitive member, develops said electrostatic latent image, and thereafter transfers said developed image.

2. Description of the Related Art

Conventional optical printers using electrophotographic methods are well known wherein, as shown in FIG. 1, individual elements L1, L2, L3, L4 (the number of elements is actually greater) are switched ON and OFF in accordance with image information and as an LED optical head 1 moves at uniform speed in the arrow "a" direction parallel to the axis of the center of rotation of the photosensitive drum 2, and an electrostatic latent image is formed on the surface of the photosensitive drum 2 via the simultaneous rotation of the said photosensitive drum 2 in the arrow "b" direction.

The aforesaid type of optical printer has a disadvantage, however, inasmuch as the electrostatic latent image formed on the surface of the photosensitive member 2 is distorted at an angle θ, as shown in FIG. 2, because the scanning speed of the optical head 1 is limited. When the scanning speed of the optical head 1 is designated Va, the peripheral speed of the photosensitive drum 2 is designated Vb, and the scan length is designated L, the amount of distortion Lp can be expressed by Equation (1) below.

$$Lp=L(Vb/Va) \quad (1)$$

Furthermore, the distortion angle θ can be expressed by Equation (2) below.

$$\theta=\tan^{-1}(Lp/L)=Lp/L \quad (2)$$

In FIG. 2, L1'–L4' indicates the optical irradiation positions corresponding to the individual elements L1–L4 of the optical head 1.

As shown in FIG. 2, when the electrostatic latent image having a distortion of angle θ is developed and transferred, the distortion is transferred directly to the transfer sheet. In order to eliminate this disadvantage, serial printers of the inkjet type and the like have been devised wherein the rotation of the photosensitive drum 2 is stopped during one scan by the optical head 1. However, methods of this type pose another disadvantage inasmuch as the drive systems are much noisier and transfer sheet transport control and rotation control of the photosensitive drum 2 are more complex.

Japanese Laid-Open Patent Application No. Hei 4-114181 discloses a method preventing image distortion by providing a twist to the scanning direction of the optical head 1 relative to the axial direction of the photosensitive drum 2. However, this method poses certain disadvantages in that the optical head scanning path must be constructed with complex curves (spirals) in order to prevent previously described image distortion, such that, when said scanning path approaches a straight line, the distance between said optical head and the surface of the photosensitive member cannot be maintained uniform throughout the entire scan region.

SUMMARY OF THE INVENTION

A main object of the present invention is to provide an optical printer capable of transferring an image onto a transfer sheet while correcting by means of a simple construction the regular distortion of an image formed on the surface of a photosensitive member scanned by an optical head.

A further object of the present invention is to provide an optical printer capable of correcting the previously described image distortion while continuously rotating the photosensitive member and transporting transfer sheet at uniform speed.

These and other objects of the present invention are accomplished by providing an optical printer comprising a photosensitive member which is rotatably driven at uniform speed, an optical head which forms a latent image on the surface of the photosensitive member by switching ON and OFF the light emitted therefrom in accordance with image information while moving parallel to a rotation axis of the photosensitive member at uniform speed, a developing device which develops the latent image formed by the optical head, a transfer section for transferring a toner image formed by the developing device onto a transfer sheet and a transporting device which transports a transfer sheet from a sheet accommodating section to the transfer section and a fixing section, the transporting device transporting the transfer sheet at least at the transfer section in a direction inclined relative to a direction perpendicular to the rotation axis of said photosensitive member at an angle corresponding to distortion of the latent image which occurs when said optical head forms the latent image on the surface of the photosensitive member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiment of the present invention are described hereinafter with reference to the accompanying drawings.

Figure 1:
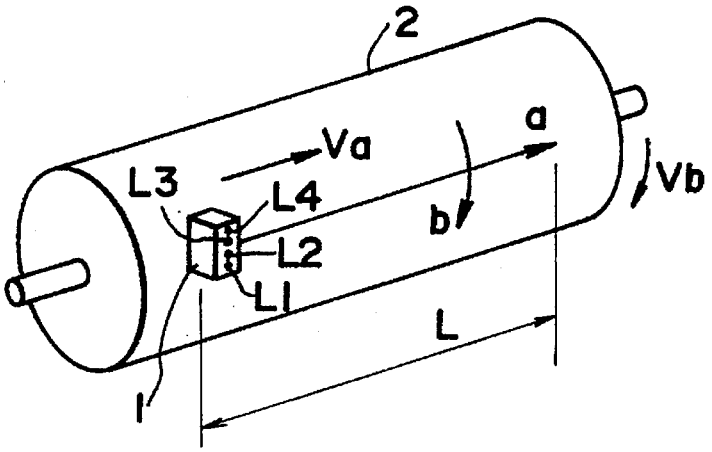
FIG.1 Prior art
FIG. 1 is a perspective view showing the electrostatic latent image formation in a conventional optical printer.
Figure 2:
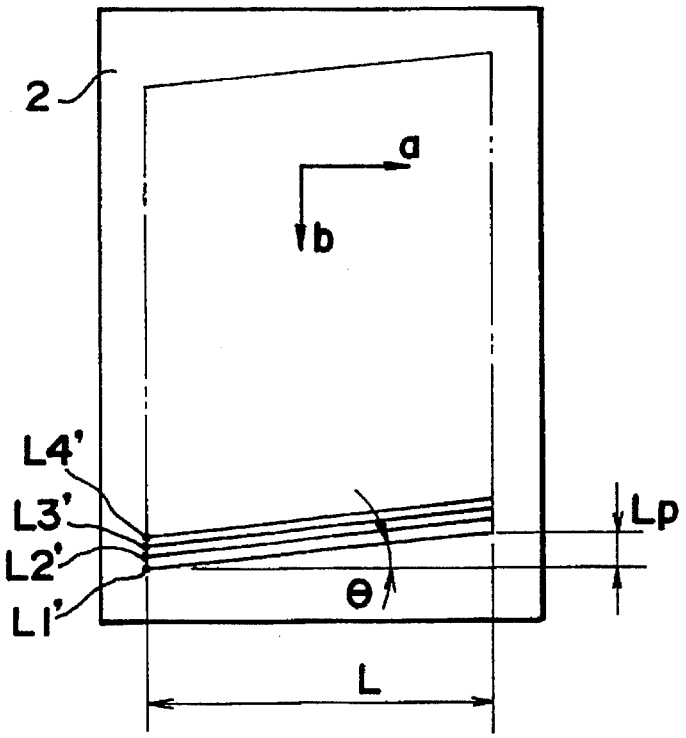
FIG.2 Prior art
FIG. 2 is a development view showing an electrostatic latent image formed on the surface of a photosensitive member in a conventional optical printer.
Figure 3:
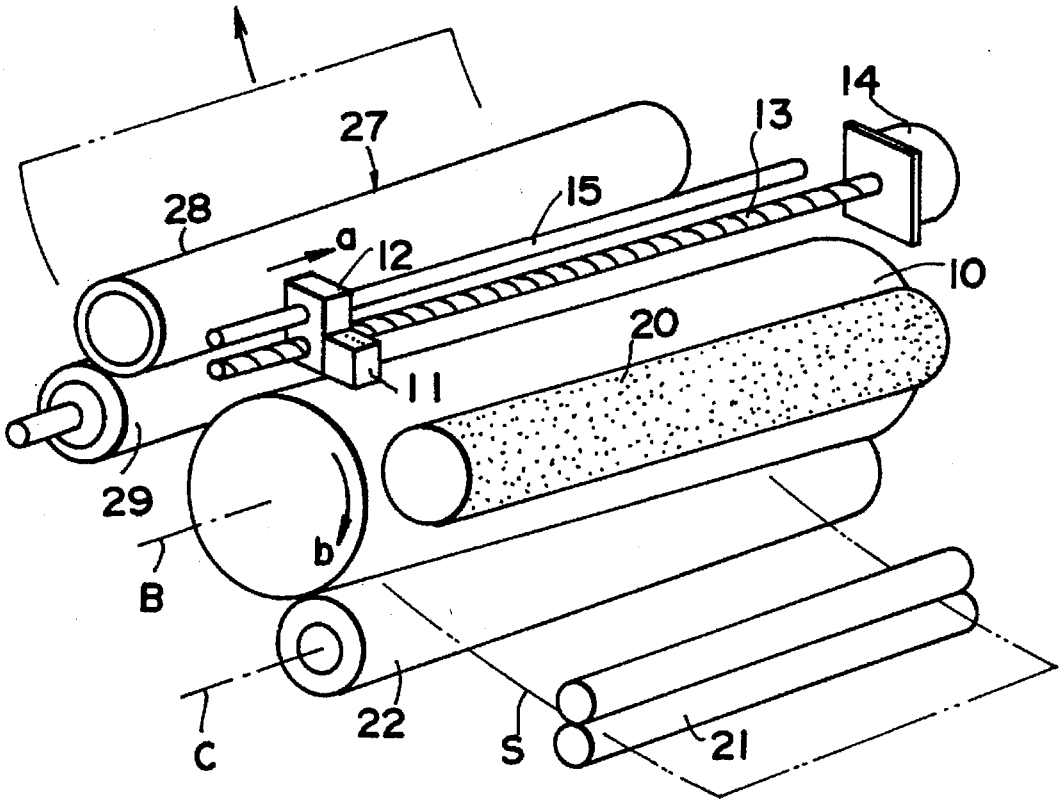
FIG. 3 is a perspective view showing a first embodiment of the present invention.
Figure 4:
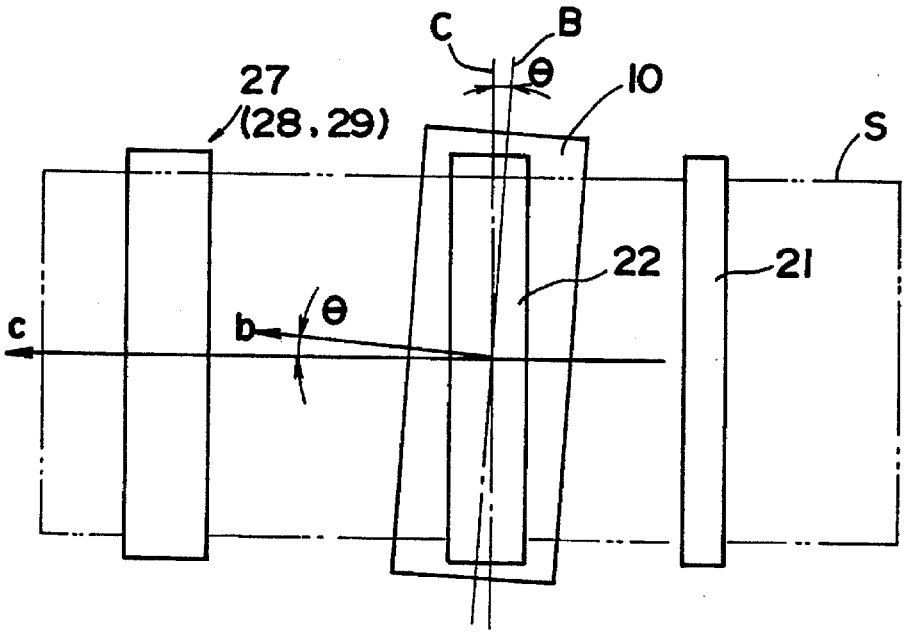
FIG. 4 is a bottom view of the first embodiment.

First Embodiment (refer to FIGS. 3 and 4)

In FIGS. 3 and 4, reference numeral 10 refers to a photosensitive drum, reference numeral 11 refers to an LED optical head, reference numeral 20 refers to a developing device of a magnetic brush type, reference numeral 21 refers to a pair of timing rollers for transporting transfer sheet S, reference numeral 22 refers to a transfer roller, reference numeral 27 refers to a toner fixing device comprising a heating roller 28 and pressure roller 29.

The LED optical head 11 is mounted on a feed screw 13 and guide rod 15 via a holder 12. The feed screw 13 is etched in a spiral shape forming a thread groove on the exterior surface, and one end of said feed screw 13 is connected to a motor 14 capable of forward and reverse rotation. The holder 12 is screwed on the feed screw 13, so as to be slidable on the guide rod 15. The feed screw 13 and guide rod 15 are installed parallel to the center of rotation axis B of the photosensitive drum 10. The LED optical head 11 moves outward at uniform speed in the direction of arrow "a" under forward rotation of the motor 14, and returns at high speed under reverse rotation of the motor 14. The individual light-emitting elements of the LED optical head 11 are switched ON and OFF during the outward travel of the LED optical head 11 in accordance with the image information so as to form an electrostatic latent image on the surface of the photosensitive drum 10 rotatably driven at uniform speed in the arrow "b" direction. Arranged around the periphery of the photosensitive drum 10, but not shown in the drawings, is a charger for uniformly charging the surface of the photosensitive drum 10 to a predetermined electric potential. The electrostatic latent image formed by the LED optical head 11 is a negative image wherein the image portion (light ON portion) has a reduced electric potential. This electrostatic latent image is subjected to reversal development wherein toner is adhered to the low-potential areas (image areas) by the developing device 20, thereby forming a positive toner image.

On the other hand, the transfer sheet S is fed from a transfer sheet accommodating section not shown in the illustrations, and is transported to the transfer section synchronously with the aforesaid toner image by means of the pair of timing rollers 21. The transfer roller 22 is formed out of flexible member, and is installed so as to be rotatably driven while in pressure contact with the surface of the photosensitive drum 10; the voltage applied to the transfer roller 22 has a polarity that is opposite the polarity of the toner charge. The toner image is transferred onto the transfer sheet S when said transfer sheet S passes through the nip portion formed between transfer roller 22 and the photosensitive drum 10. This toner image transfer is not accomplished via a conventional rolling contact, but rather is accomplished by means of the twisting contact characteristic of the present invention, and which is described in detail later.

The transfer sheet S onto which the toner image has been transferred is then transported to the fixing device 27, which fuses the toner onto the sheet. The transfer sheet is thereupon discharged to a tray or sorter not shown in the illustrations.

In the first embodiment, the LED optical head 11 scans the surface of the photosensitive drum 10 while moving in the arrow "a" direction parallel to the center of rotation axis B of said photosensitive drum 10. Accordingly, the electrostatic latent image formed on the surface of the photosensitive drum 10 is formed such that a distortion Lp is produced at the terminal end in the scanning direction, as shown in FIG. 5, and the distortion angle θ can be expressed by means of the afore-said Equation (2). More specifically, when the number of light-emitting elements of the LED optical head 11 is set at 64 individual elements and image density is set at 300 dpi (dots per inch), the width in the sub-scanning direction (rotational direction of the drum 10) can be expressed as follows.

$$\{(62\times25.4)/300\}=5.42\text{ mm}$$

When the scan length L is set at 220 mm, the distortion angle θ can be expressed as follows according to the afore-said Equation (2).

$$\theta=\tan^{-1}(5.42/220)=1.41°$$

In the first embodiment, the center of rotation axis C of the transfer roller 22 is inclined by the aforesaid distortion angle θ relative to the center of rotation axis B of the photosensitive drum 10, as shown in FIG. 4. Similarly, the center of rotation axes of the pair of timing rollers 21 and the fixing rollers 28 and 29 are also inclined by angle 8. Thus, the transfer sheet S is transported in the arrow "c" direction with an inclination of angle θ relative to the direction "b" perpendicular to the center of rotation axis B of the photosensitive drum 10.

In conventional optical printers of this type, the transfer sheet is transported in a direction (arrow "b" direction) perpendicular to the center of rotation axis B of the photosensitive drum 10, such that the transfer is accomplished with the transfer sheet in rolling contact with the surface of the photosensitive drum 10. In this type of transfer method, the distortion of the electrostatic latent image is transferred directly onto the transfer sheet S as a toner image, as shown in FIG. 5(*c*). Notwithstanding that said transfer sheet S is transported in the arrow "c" direction with an inclination of angle θ in the rolling contact transfer method as shown in FIG. 5(*d*), the image scanning direction coincides with the transfer sheet S but the sub-scanning direction does not coincide therewith, and thus the image may overflow from the transfer sheet S.

In the first embodiment, however, a toner image is formed corrected for the distortion of the electrostatic latent image, and said corrected toner image is transferred onto the transfer sheet S, as shown in FIG. 5(*b*). More specifically, the toner image X formed on the surface of the photosensitive drum 10 is transported in the arrow "b" direction, and the transfer sheet S is transported in the arrow "c" direction, as shown in FIG. 6(*a*). The transport speeds at this time in the directions indicated by the arrows "b" and "c" are equal. The transfer position is ideally linear at an inclination angle θ, and in this ideal state the toner image X formed on the surface of the photosensitive drum 10 is transported sequentially onto the transfer sheet S at the linear transfer position. When the toner at position ① is transferred onto the transfer sheet S and transported to position ①', the toner at position ② is transported to position ②', and the toner at position ③ at this time is transferred at position ③'. Thus, the toner image X is transferred onto the transfer sheet S.

The toner particles at the transfer positions receive transport force Fb in the "b" direction from the photosensitive drum 10 and a transport force Fc in the "c" direction from the transfer sheet, thereby receiving a twisting force Fr in the "r" direction, as shown in FIG. 6(*b*). The parallelogram toner image X is transferred onto the transfer sheet S in a corrected state as rectangular toner image X' via the twisting force imparted to the toner at the transfer position as previously described.

A condition which must be satisfied to achieve proper execution of the previously described transfer via twisting contact is that the frictional force between the transfer sheet S and the transfer roller 22 is greater than the frictional force between the transfer sheet S and the photosensitive drum 10. A further condition is that, normally, the friction coefficients of the surface of the photosensitive drum 10 and the transfer roller 22 are such that the friction coefficient of the latter is rather greater.

The transfer roller 22 is formed out of a flexible material which becomes slightly deformed when in pressure contact with the surface of the photosensitive drum 10, such that the transfer sheet S actually makes touching contact with the surface of the photosensitive drum 10 over a width of about 10 mm. Therefore, the transfer position is not the linear position of the previously described ideal state, but rather has a particular width W (refer to FIG. 6(*a*). The transfer force relative to the toner particles gradually increases directly in front of the transfer position, and gradually decreases directly behind the transfer position, as shown in FIG. 6(*a*). When the transfer is accomplished over the aforesaid width via the twisting contact, the toner particles slide in the direction "r" during the transfer process. When the distortion angle θ is 1.41° and the toner particle transfer starts 3 mm in front of the transfer position, the toner particles slide approximately 0.07 mm in the "r" direction. This sliding of the toner particles is produced so as to include all toner particles, such that there is no loss in the correction of the distortion of the toner image X.

In the present invention, when considering the previously described twisting and sliding of the toner particles, is it desirable to add toner which slides readily or particles which enhance the sliding of the toner. An example of toner which slides readily is toner manufactured in a spherical particle shape. Furthermore, sliding of the toner particles is enhanced by adding spherical micro particles of silica of less than 0.1 μm in diameter to the toner at a rate of 0.5~0.1 parts-by-weight.

To achieve effective twisting and sliding of the toner particles, it is desirable that the transport force Fc imparted by the transport system to the transfer sheet S is set so as to be greater than the transport force Fb imparted by the photosensitive drum 10. More specifically, the transfer roller 22 may be fabricated of a material which readily absorbs static electricity of the transfer sheet S, or the transfer voltage may be set high. Either course results in an increase in the amount of wrapping of the transfer sheet S around the transfer roller 22, thereby increasing the transport force Fc. Furthermore, disposing the pair of timing rollers 21 near the transfer roller 22 is effective in increasing the rigidity of the transfer sheet S in the transfer section. The angle of inclination θ of the transfer roller 22 (angle formed by the rotational center axes B and C in FIG. 4) may also be increased.

The arrangement of the light-emitting element array of the LED optical head 11 is described hereinafter.

In the first embodiment, the LED optical head 11 is provided with an array wherein 64 individual light-emitting elements are disposed in a single row so as to form an image density of 300 dpi. Normally, the 64 individual light-emitting elements are arranged in a direction perpendicular to the scanning direction "a." However, when an electrostatic latent image is formed on the surface of the photosensitive drum 10 by means of the aforesaid array, and the distortion angle θ is 1.41° as shown in FIG. 7(*a*), a difference of level of 0.13 mm is produced on each scan line at both ends in the scanning direction.

Figure 7A:
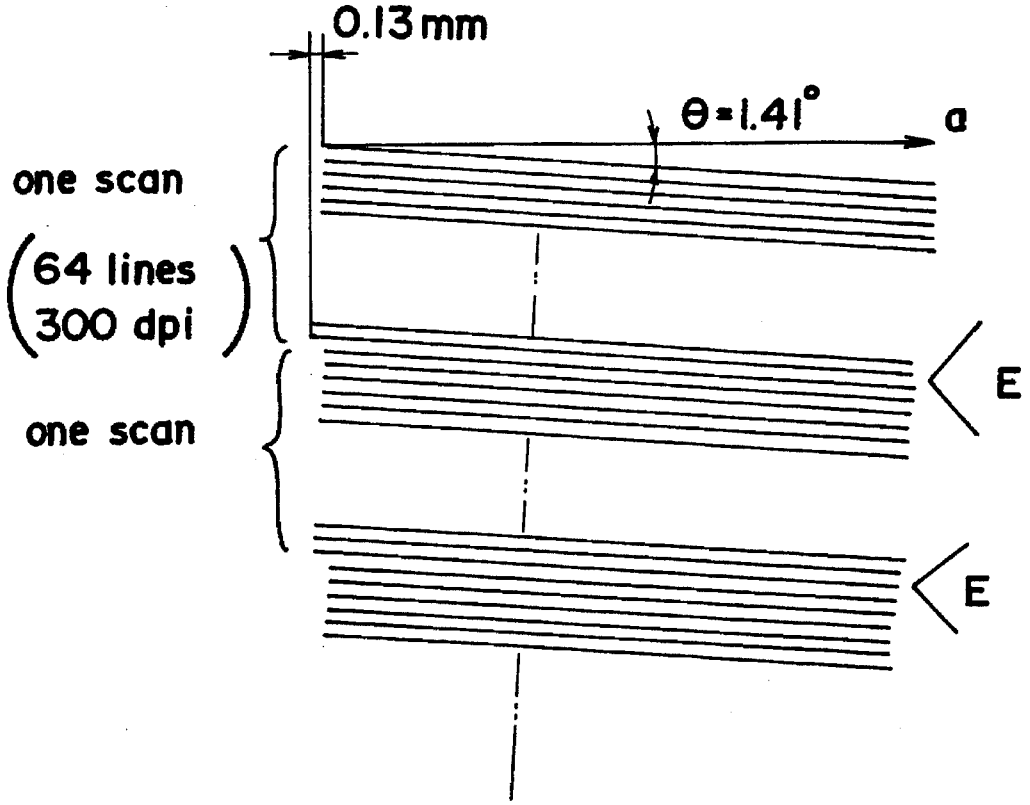
FIGS. 7(*a*) and 7(*b*) are illustrations showing arrangement of the light-emitting element array of the LED optical head.
Figure 7B:
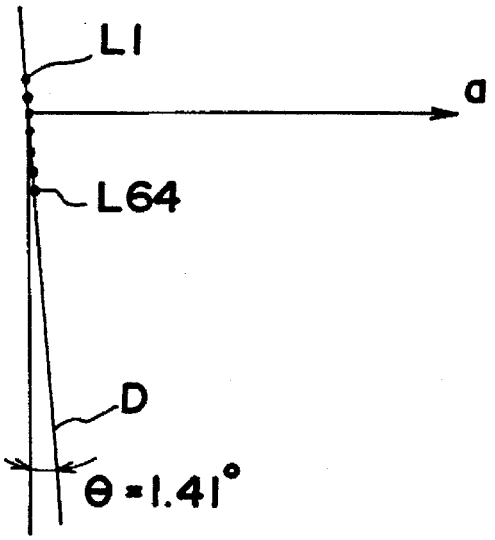

To prevent the occurrence of the aforesaid difference in level, the direction D of the array of light-emitting elements L1–L64 is set at a suitable angle relative to a direction perpendicular to the scanning direction "a," said suitable angle being preferably inclined on the scanning direction "a" side by the distortion angle θ, as shown in FIG. 7(*b*). Thus, the electrostatic latent image formed on the surface of the photosensitive drum 10 forms a parallelogram at the distortion angle θ, thereby eliminating the difference in level at both ends.

Figure 8:
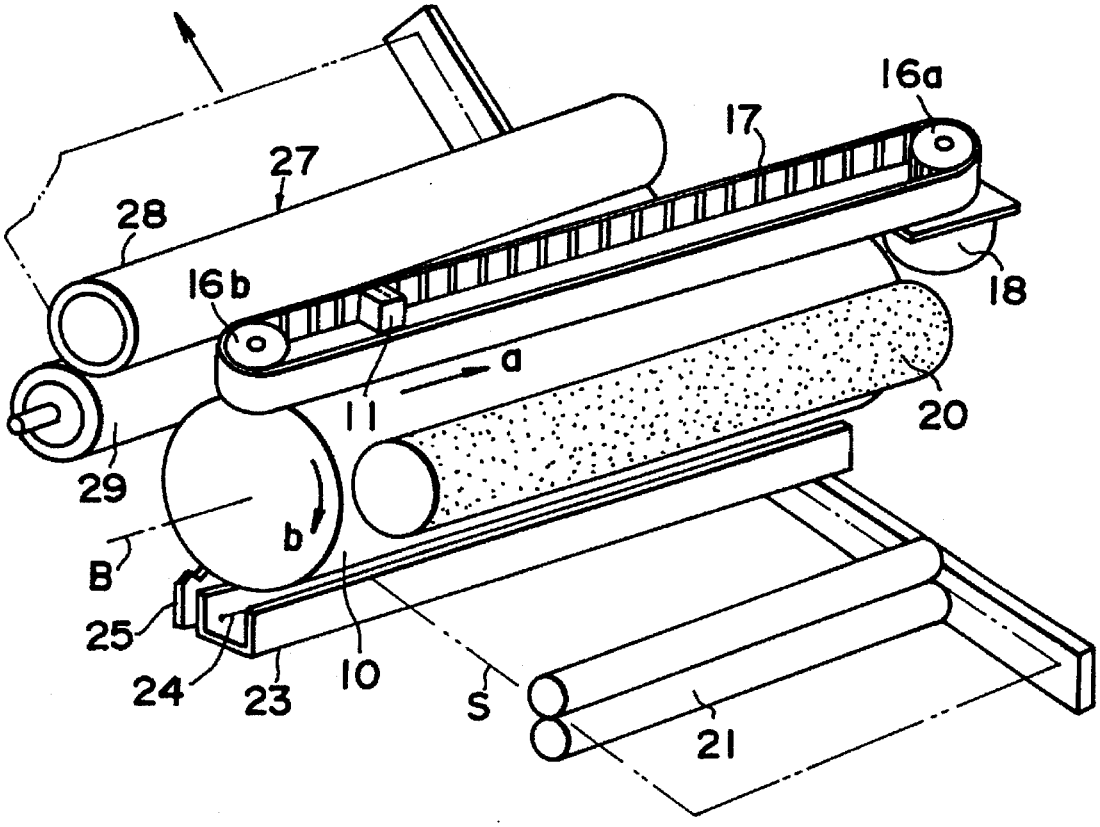
FIG. 8 is a perspective view showing a second embodiment of the present invention.
Figure 9:
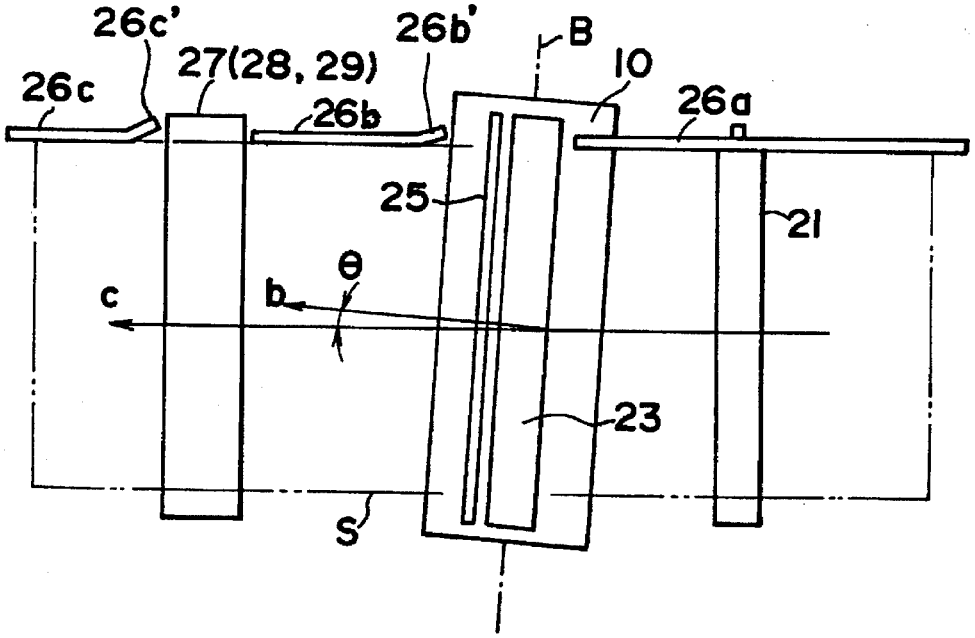
FIG. 9 is a bottom view of the second embodiment.

Second Embodiment (refer to FIGS. 8 and 9)

A second embodiment of the invention uses a transfer charger 23 of the corona discharge type as the transfer means, wherein a voltage is applied to the charging wire 24 which has a polarity opposite the polarity of the toner charge polarity. A discharge electrode 25 is provided in the back portion of the transfer charger 23 to discharge the load of the transfer sheet S to separate said transfer sheet S from the surface of the photosensitive drum 10. The transfer charger 23 does not participate in the transport of the transfer sheet S as did the transfer roller 22 described in the first embodiment. Accordingly, the direction of installation of said transfer charger 23 is optional. More specifically, the charging wire 24 is arranged parallel to the rotational center axis B of the photosensitive drum 10.

Transport of the transfer sheet S is achieved by providing sheet guide panels 26*a*, 26*b*, 26*c* on a transport reference line, and inclining the pair of timing rollers 21 and fixing rollers 28 and 29 by the distortion angle θ relative to the rotational center axis B. The guide panels 26*b* and 26*c* curve outwardly at sections 26*b'* and 26*c'* for accommodating the introduction of the transfer sheet S, such that the leading edge of the transfer sheet S does not collide therewith.

The LED optical head 11 is fixedly attached to a timing belt 17 laced around the pulleys 16*a* and 16*b*. The LED optical head 11 travels outward (scan) at constant speed in the arrow "a" direction parallel to the rotational center axis B of the photosensitive drum 10, and returns in the opposite direction at high speed via the forward and reverse rotation of the pulley 16*a* accomplished by means of the motor 18.

Figures 5A, 5B, 5C, 5D:
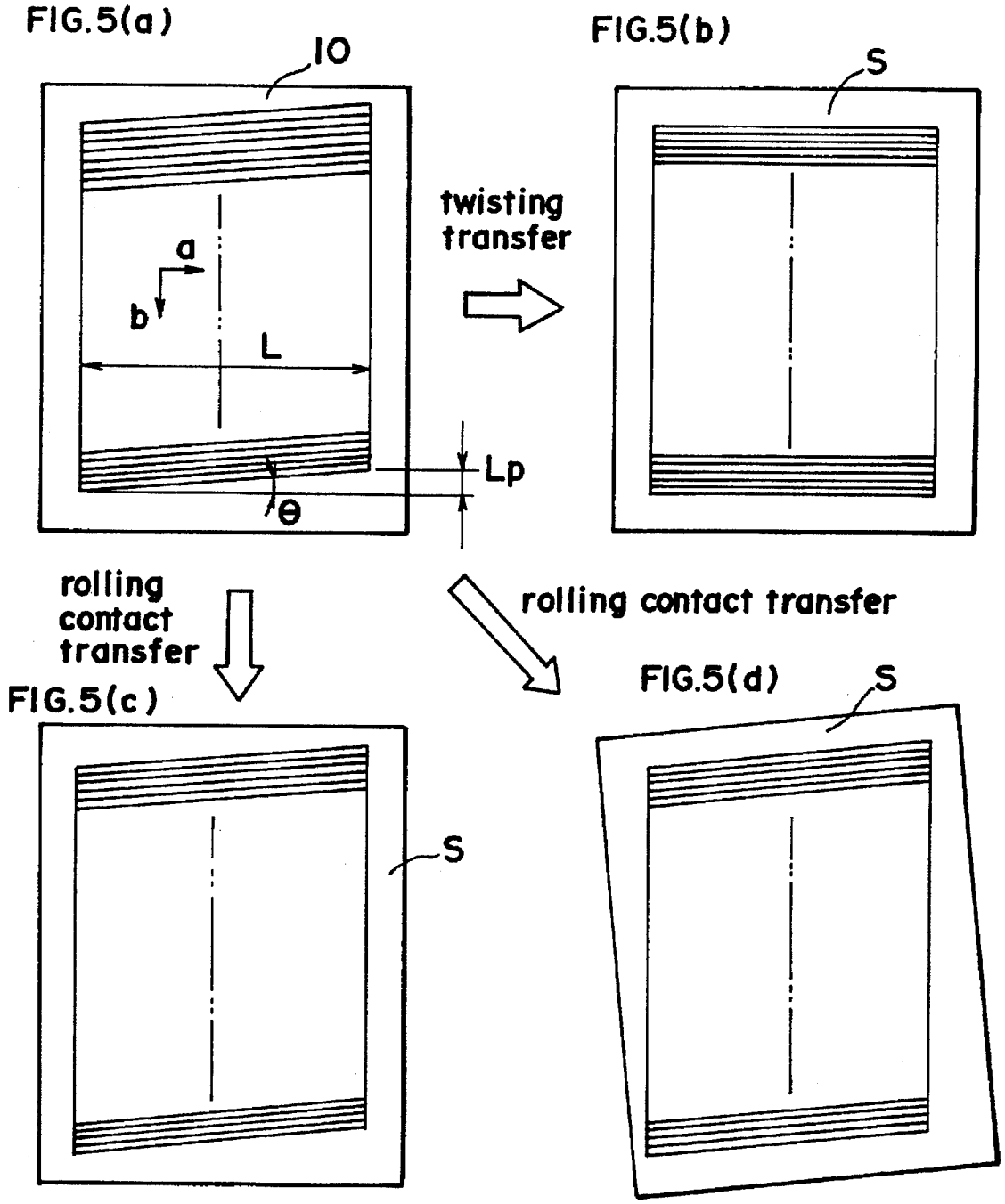
FIGS. 5(*a*), 5(*b*), 5(*c*), and 5(*d*) are illustrations showing an image formed on the surface of a photosensitive member and the transfer of said image onto a transfer sheet.
Figure 6A:
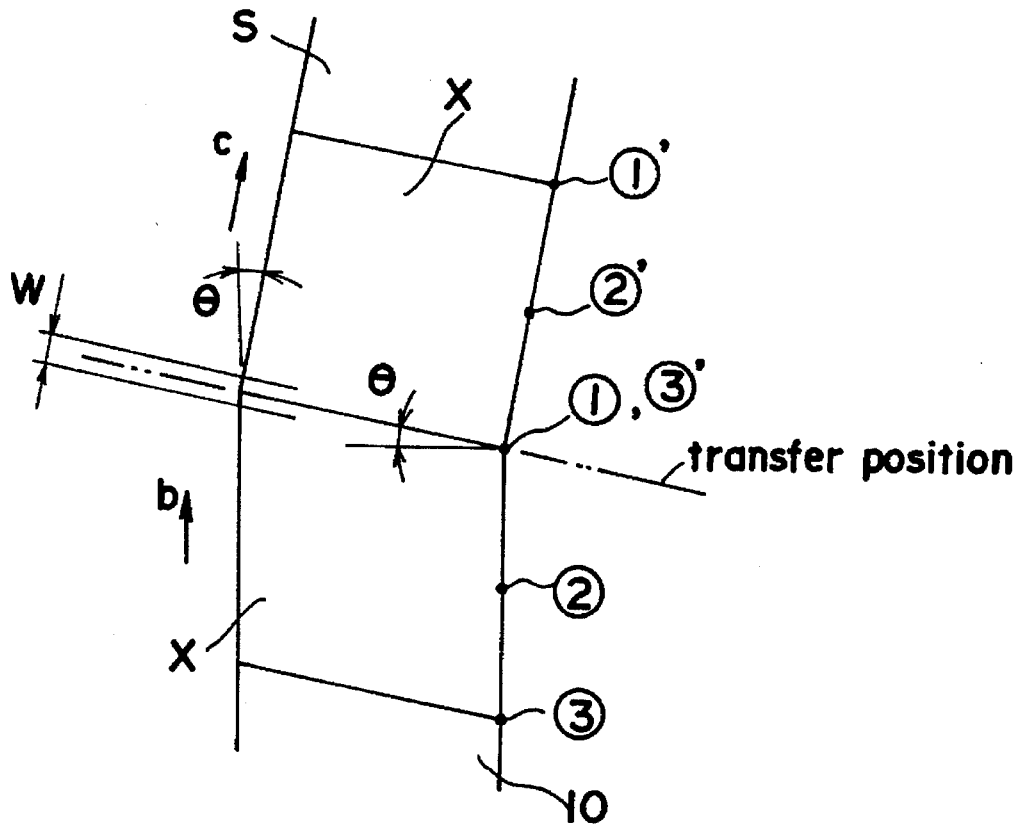
FIGS. 6(*a*) and 6(*b*) are illustrations of a transfer by means of a twisting contact.
Figure 6B:
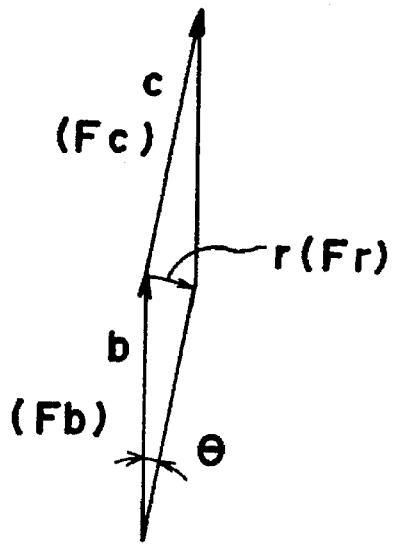

In the second embodiment of the aforesaid construction, the electrostatic latent image formed on the surface of the photosensitive drum 10 via the forward travel of the LED optical head 11 in the arrow "a" direction has a distortion angle θ identical to that described in the first embodiment, as shown in FIG. 5*a*. This electrostatic latent image is developed by developing device 20, and the resulting toner image is transferred onto a transfer sheet S transported in the arrow "c" direction, said toner image transfer being accomplished by means of a discharge from the transfer charger 23 in the transfer section. The transfer is accomplished at this time by means of the previously described twisting contact shown in FIG. 6, such that the toner image is transferred onto the transfer sheet S in a state wherein the distortion produced in the latent image has been corrected.

In the second embodiment, the transfer charger 23 does not participate in the transport of the transfer sheet S and, therefore, the transport direction "c" of the transfer sheet S must be stabilized. Thus, guide panels 26*a*, 26*b*, 26*c* are provided along the transport reference line. In order to render the transport direction more stable, the pair of timing rollers 21 and fixing rollers 28 and 29 are constructed so as to exert a force on the transfer sheet S toward the guide panels 26*a*, 26*b*, 26*c*, e.g., it is desirable that measures be implemented such as providing said rollers with a taper or the like. Furthermore, the transfer sheet S may be transported by belt or rollers of a vacuum suction type, chucking the leading edge of the transfer sheet, or gripping the front and back surfaces of the transfer sheet with belts.

Furthermore, a charger of the scorotron type may be used as the transfer charger 23.

Figure 10:
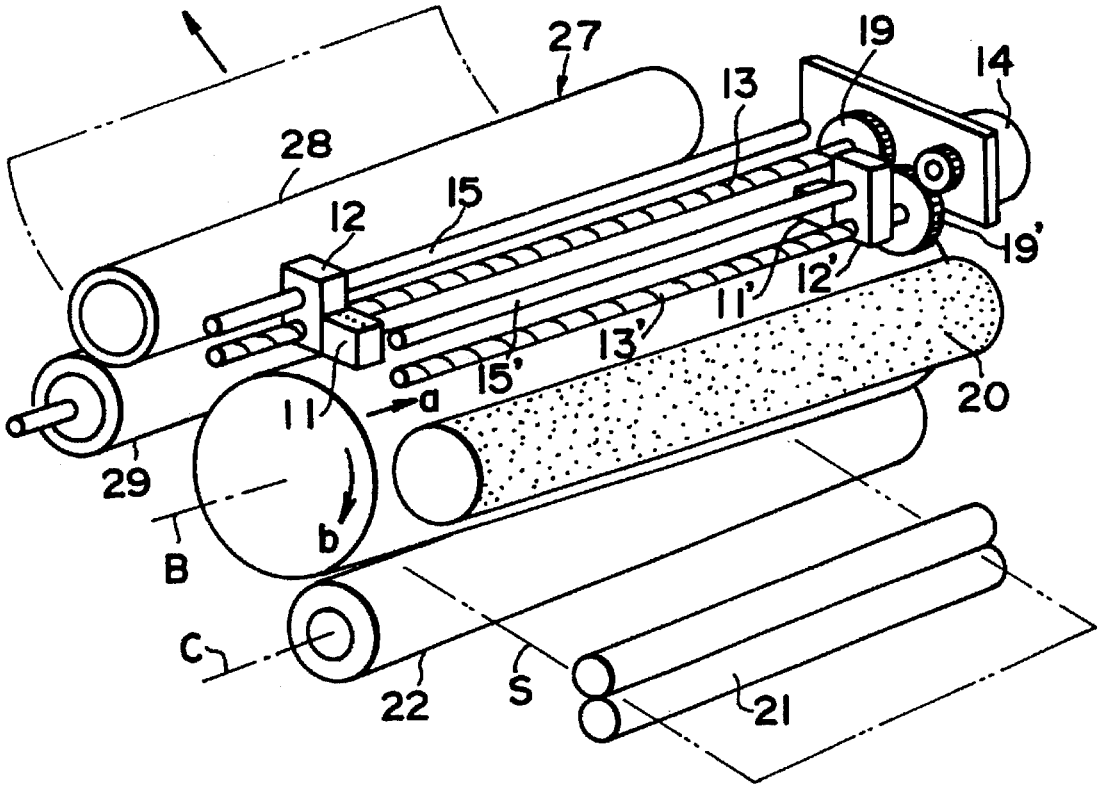
FIG. 10 is a perspective view of a third embodiment of the present invention.
Figure 11:
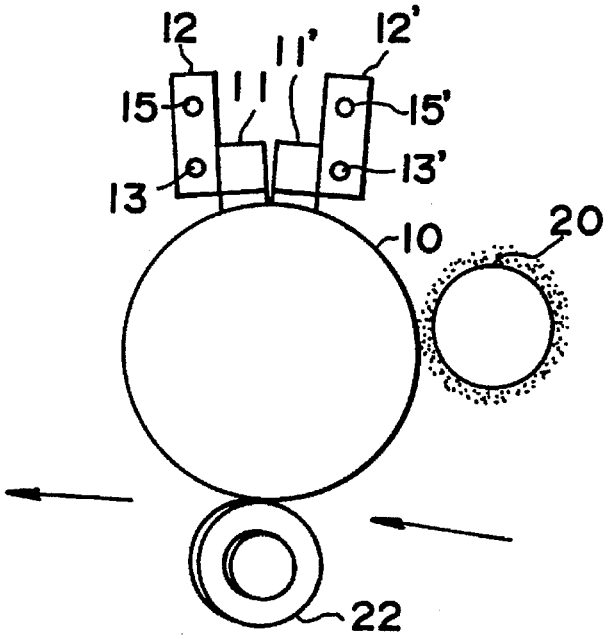
FIG. 11 is a bottom view of the third embodiment.

Third Embodiment (refer to FIGS. 10 and 11)

The third embodiment has basically a similar construction to that of the first embodiment shown in FIGS. 3 and 4. The third embodiment differs from the first embodiment in that an LED optical head 11' is provided in addition to the LED optical head 11, such that said LED optical heads move reciprocally in mutually opposite directions. The additional LED optical head 11' is mounted on a feed screw 13' and guide rod 15' via a holder 12', and is positioned in rotational symmetry relative to the LED optical head 11 centered on the rotation center axis B of the photosensitive drum 10. Mutually engaging gears 19 and 19' are provided at the ends of the feed screws 13 and 13', said gear 19' being rotatably driven in forward and reverse directions via the motor 14.

The home position of the LED optical head 11 is disposed on the upstream side in the scanning direction "a," and the LED optical head 11' home position is disposed on the downstream side. Accordingly, when the LED optical head 11 is traveling outward, the LED optical head 11' is returning (or vice versa), and the individual light-emitting elements of both LED optical heads are turned ON and OFF during outward travel so as to form an electrostatic latent image on the surface of the photosensitive drum 10.

The reasons for providing two individual LED optical heads 11 and 11' are described hereinafter. When a single LED optical head 11 is used, the electrostatic latent image formed by each scan produces a blank area corresponding to the distance of the rotation of the photosensitive drum 10 during the return travel because said photosensitive drum 10 rotates in the arrow "b" direction even during said return travel. FIG. 7(*a*) is illustrated on the assumption that the return travel time is zero. Actually, a slight blank area is produced during a single scan (section E), such that curves and diagonal lines do not appear smooth. However, when a pair of LED optical heads 11 and 11' are provided so as to travel in a mutually reciprocal manner such that an electrostatic latent image is formed while one optical head travels outward as the other optical head returns, as in the third embodiment of the present invention, the blank area produced by one scan overlaps the blank area produced by the other scan. Thus, the blank area of one scan is eliminated, thereby producing an image having the density shown in FIG. 7(*a*), and smoothly reproducing curves and diagonal lines.

Of course the third embodiment accomplishes the toner image transfer by means of the twisting contact described in the first embodiment.

Other Embodiments

The optical printer of the present invention is not limited to the previously described embodiments, and may be variously modified insofar as such modifications do not depart from the scope of the present invention.

For example, an optical head of a type other than an LED, such as PLZT or liquid crystal shutter elements may be used if the light is turned ON and OFF while the optical head itself travels parallel to the rotational center axis of the photosensitive drum 10. Furthermore, a laser light source may be used, fluorescent character display tube, EL light source, or plasma light source may alternatively be used.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An optical printer comprising:

a photosensitive member rotatably driven at uniform speed;

an optical head for forming a latent image on the surface of said photosensitive member by switching ON and OFF light emitted therefrom in accordance with image information while moving parallel to a rotation axis of said photosensitive member at uniform speed;

a developing device for developing the latent image formed by said optical head;

a transfer section for transferring a toner image formed by said developing device onto a transfer sheet, and a transporting device for transporting a transfer sheet from a sheet accommodating section to said transfer section and a fixing section, said transporting device transporting the transfer sheet at least at the transfer section in a direction inclined relative to a direction perpendicular to the rotation axis of said photosensitive member at an angle corresponding to distortion of the latent image which occurs when said optical head forms the latent image on the surface of the photosensitive member.

2. The optical printer as claimed in claim 1 wherein said transporting device includes at least a pair of timing rollers and a pair of fixing rollers, the rotation axes of both roller pairs being inclined at an angle corresponding to the distortion of the latent image relative to the direction perpendicular to the rotation axis of said photosensitive member.

3. The optical printer as claimed in claim 1 wherein said transfer section includes a transfer roller in pressing contact with the surface of said photosensitive drum, the rotation axis of the transfer roller being inclined at an angle corresponding to the distortion of the latent image.

4. The optical printer as claimed in claim 3, wherein said transfer roller is made of elastic material.

5. The optical printer as claimed in claim 1 wherein said transfer section includes a charger of corona discharge type.

6. The optical printer as claimed in claim 5 wherein said transport device includes guide plates for guiding the side of a transfer sheet in the direction inclined at the angle corresponding to distortion of the latent image relative to a direction perpendicular to the rotation axis of said photosensitive member.

7. The optical printer as claimed in claim 1 further comprising a second optical head movable at uniform speed parallel to the rotation axis of said photosensitive member, said second optical head forming a latent image on the surface of said photosensitive member at a time different from the time at which the first optical head forms a latent image on said photosensitive member.

8. An optical printer comprising:

a photosensitive member rotatably driven at uniform speed;

an optical head for forming a latent image on the surface of said photosensitive member by switching ON and OFF light emitted from said optical head in accordance with image information while moving at uniform speed parallel to the center of rotation axis of said photosensitive member;

a developing device for developing an electrostatic latent image formed on the surface of said photosensitive member;

a transfer device facing to said photosensitive member; and a supplying device which supplies a recording sheet between said photosensitive member and said transfer device in a direction inclined relative to a direction perpendicular to the rotation axis of said photosensitive member at an angle of distortion of the latent image which occurs when said optical head forms the latent image on the surface of the photosensitive member.

* * * * *